United States Patent [19]

Colangelo

[11] 4,215,389

[45] Jul. 29, 1980

[54] BATTERY OPERATED LIGHT

[76] Inventor: Fernando M. Colangelo, 1315 E. Camelback, Phoenix, Ariz. 85014

[21] Appl. No.: 859,791

[22] Filed: Dec. 12, 1977

[51] Int. Cl.[2] ..... F21L 7/00

[52] U.S. Cl. ..... 362/199; 362/200; 200/51.14

[58] Field of Search ..... 362/200, 196, 208, 203, 362/204, 198, 35, 66, 199, 20, 185, 197; 200/181, 182, 51.14

[56] References Cited

U.S. PATENT DOCUMENTS

| | | | |
|---|---|---|---|
| 1,528,811 | 3/1925 | Zeiler | 362/200 |
| 2,349,453 | 5/1944 | Noel | 362/197 |
| 2,369,637 | 2/1945 | Baird | 362/185 |
| 3,175,080 | 3/1965 | Moore | 362/196 |
| 3,683,423 | 8/1978 | Crapanzano | 200/182 |
| 3,711,703 | 1/1973 | Bacevius | 362/196 |
| 3,781,502 | 12/1973 | Schumacher | 200/221 |
| 3,973,092 | 8/1976 | Breed | 200/221 |

FOREIGN PATENT DOCUMENTS

| | | | |
|---|---|---|---|
| 1291402 | 3/1969 | Fed. Rep. of Germany | 200/182 |
| 107658 | 7/1917 | United Kingdom | 362/199 |

*Primary Examiner*—Stephen C. Bentley
*Assistant Examiner*—Edward F. Miles
*Attorney, Agent, or Firm*—Gregory J. Nelson

[57] ABSTRACT

A flashlight having a frame supporting battery cells in spaced apart side-by-side relationship. One or more bulbs are rotative from an "off" position between the batteries to an "on" position in which the circuit is complete. The flashlight may be enclosed in a case including a clip or other means for attaching the light to an article of apparel. In an alternate embodiment, the light includes a mercury switch and is activated by tilting the light to a predetermined position.

6 Claims, 6 Drawing Figures

BATTERY OPERATED LIGHT

The present invention relates to a small, portable, battery operated electric light generally termed a "flashlight".

Battery operated lights or flashlights are well known. Generally, these lights include a cylindrical housing containing two or more batteries. On end of the housing is closed by a cap which secures a reflector lens and transparent lens cover in place. A switch located on the side of the cylindrical housing serves to control the battery circuit to operate the light as desired. Lights of this general type have several shortcomings. First, conventional flashlights are often bulky and do not lend themselves to being conveniently carried about by the user. Secondly, the design of the conventional flashlight places the bulb and lens at one end in a postion so that the bulb or lens cover may be broken if the light is inadvertently dropped. Further, the conventional flashlight is of a design that is not easily adapted to be clipped or secured to articles of clothing so the hands of the user are free to perform other tasks.

Briefly, the present invention provides a small, portable, battery operated electric light which is compact and simple. The light of the present invention uses batteries of any size. A novel switch arrangement places the bulb in a protected position when the lamp is not in use, so the bulb is virtually unbreakable. The structure includes a frame for securing two or more batteries in a generally side-by-side position with a space between the batteries. The frame includes conductor elements for interconnecting the batteries in side-by-side relationship. The bulb is associated with one of the interconnecting conductor members and is rotatively supported on the member. A portion of the conductor member is insulated so the bulb or multiple bulbs may be pivoted from a position in which the circuit is complete and the bulb illuminated to a position in which the circuit is broken and the bulb housed in an out-of-the-way position between the batteries. In an alternate embodiment of the invention, the operation of the unit is controlled by a mercury switch requiring that the flashlight unit be tilted to a predetermined position to complete the electrical circuit. A reflector may also be associated with the unit.

The above and other advantages and features of the present invention will become more apparent from the following description, claims and drawings in which:

Figure 1:
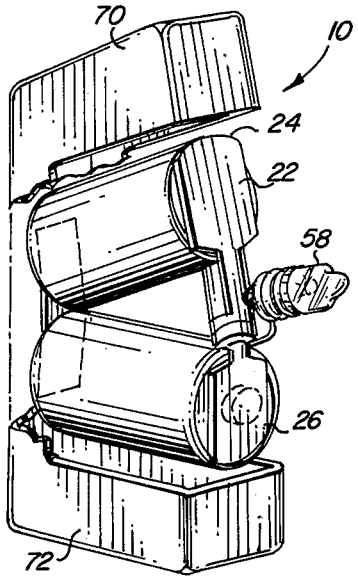
FIG. 1 is a perspective view illustrating a preferred embodiment of the flashlight of the present invention.
Figure 2:
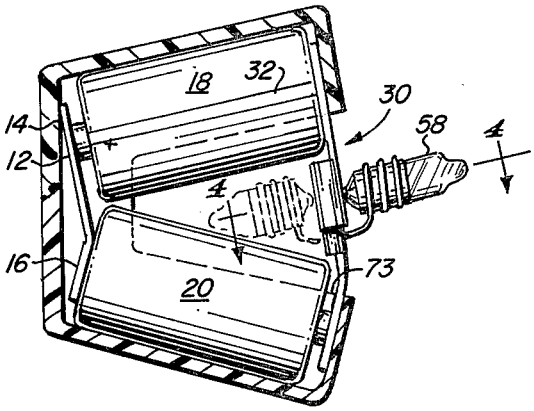
FIG. 2 is a sectional view of the flashlight illustrating FIG. 1.

Turning now to the drawings, a preferred form of the flashlight of the present invention is shown in FIGS. 1 to 4 and is generally designated by the numeral 10. Light 10 includes a battery retention frame 11 including a lower conductor element 12 of copper or other conductive material having sections 14 and 16 disposed at an angle relative one to another so the contained batteries 18 and 20 are spaced apart at an angular position as shown. The lower positive terminal of battery 18 is connected to the lower negative terminal of battery 20 by means of conductor 12. An upper conductor element 22 engages the upper negative terminal of battery 18 and is preferrably provided with a lip 24 to secure the battery in place. A similar conductive element 26 is in contact with the upper positive terminal of battery 20. Conductor elements 22 and 26 are connected to intermediate switch assembly 30 as will be more fully explained. The battery frame assembly may also include member 32 of non-conductive material securing the upper and lower conductors together to permit the batteries to be tightly secured in place. Element 32 may be adjustable to accommodate various sizes of batteries.

Figure 4:
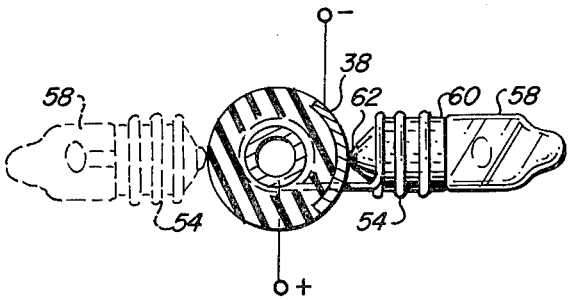
FIG. 4 is a view taken along lines 4—4 of FIG. 2.
Figure 3:
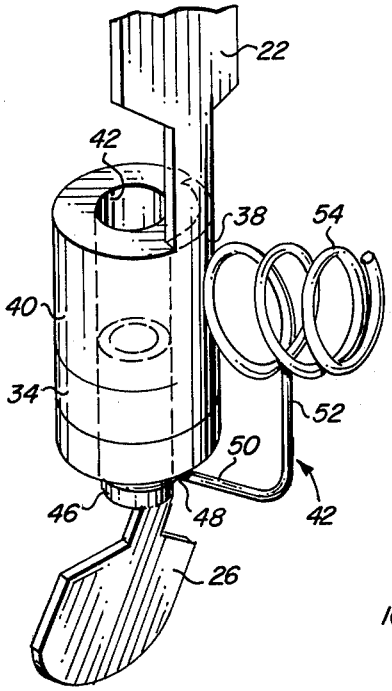
FIG. 3 is an enlarged detailed view of the conductor element extending between the batteries and securing the bulb in place.

Switch 30 is shown in greater detail in FIGS. 3 and 4. Switch 30 includes a circular conductive member 34 connected to conductor element 22 by an elongated band 38 of conductive material. A hollow cylindrical non-conductive member 40 is secured within circular band 34. Cylindrical member 40 may be of ceramic or any other suitable non-conductive material. Conductive member 26 is secured within the cylindrical opening 42 of member 40 by cylindrical insert 46 by suitable interference fit.

A bulb holder 42 includes a ring 48 positioned about the projecting portion of insert 46. Ring 48 is connected to a wire 50 which, in turn, is bent at 90° to form another section 52. The terminal end of 52 is connected to a coil 54. Sections 48, 50, 52 and 54 are all conductive. A suitable bulb 58 having a threaded metal base 60 may be screwed and inserted into coil 54 as best shown in FIG. 4.

It will be apparent that when the bulb 58 is in the position shown in solid lines in FIG. 4, the terminal end 62 of the base 60 of the bulb will be in contact with element 38 establishing a circuit and thereby illuminating the bulb in the "on" position. When the bulb is pivoted about insert 46 at loop 48 to the position shown in dotted in FIG. 4, the terminal end 62 of the bulb is in contact with the non-conducting portion 40 of the switch. In this position, the electric circuit is interrupted and the light is "off". In this position, it will also be noted that the bulb is between the batteries 18 and 20 and is in a protected position to prevent inadvertant damage to the bulb. Multiple bulbs may be positioned by use of several bulb holders 42 between the batteries. In this way, additional illumination is available as required.

Referring again to FIG. 1, an appropriate case 70 may be provided with the flashlight of the present invention. The case 70 may be of any suitable material such as rubber or a plastic such as polyethylene. The case 70 includes sections 70 and 72 which encase the batteries leaving a generally V-shaped opening 73 between the sections to permit the bulb 58 to be pivoted between the "on" and "off" positions as described above.

Figure 5:
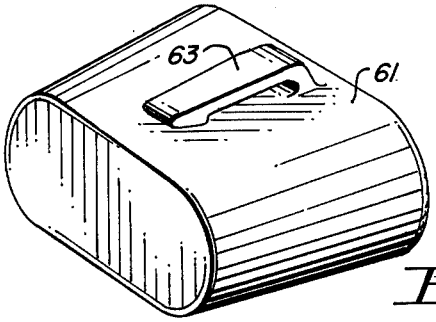
FIG. 5 is a perspective view illustrating another form of housing which may be used with the light as shown in FIGS. 1 and 2.

FIG. 5 illustrates another form of holder indicated by the numeral 61 which can be used with the embodiment of the invention shown in FIGS. 1–4. The holder 61 is provided with a pocket clip 63 which can be attached to a shirt pocket, belt, or other item of apparel of the user.

Figure 6:
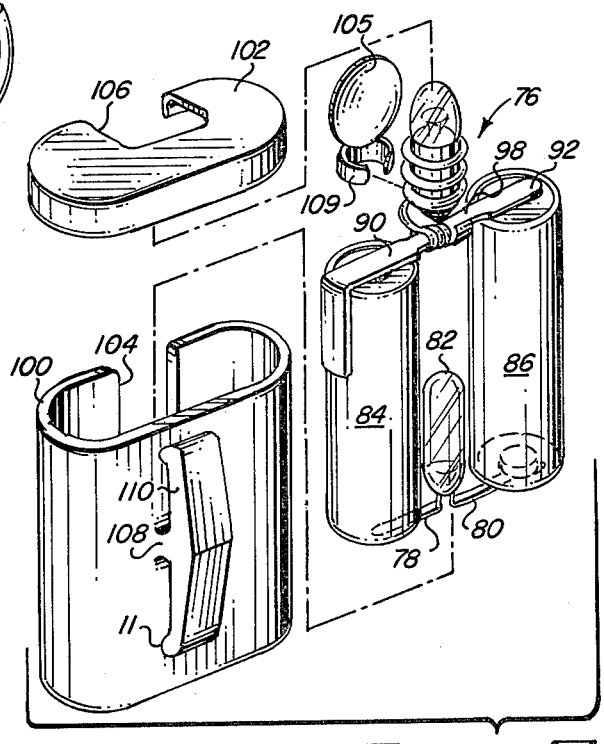
FIG. 6 is an exploded perspective view illustrating another form of the present invention.

FIG. 6 illustrates another embodiment of the present invention generally designated by the numeral 76. Again, the light of the present invention includes a battery frame having lower conductor elements 78 and 80 respectively connected to a position repsonsive device such as mercury switch 82 interposed between battery cells 84 and 86. The opposite ends of battery cells 84 and 86 are retained by conductor elements 90 and 92 which are connected to switch 98 positioned intermediate to the battery. Switch 98 is similar or identical in construction to switch 30 described with reference to FIGS. 3 and 4 and further detailed description is not deemed necessary. With the embodiment of the present invention as shown in FIG. 6, the bulb must be in position as shown in FIG. 6 in order to turn the light on. Further, the entire unit must be tilted to a position to cause mercury switch 82 to complete the circuit between conductor elements 78 and 80. Mercury switch 82 is of a type that will complete the circuit only when the entire unit is tilted with the bulb 75 in a downward position. Thus, with the unit 76 positioned as shown in FIG. 6, the bulb will not be illuminated until the entire unit is tilted to an actuated position.

A reflector 105 may be positioned adjacent bulb 75 by clips 109 secured to the bulb base. Reflector 105 permits the user to direct or concentrate the light.

An appropriate case 100 is adpated to receive unit 76. Case 100 is configured to receive the battery cells 84 and 86. A slot 104 is provided in one sidewall of the case to permit the bulb 75 to be pivoted between the "on" and "off" positions as described. Cover 102 has an appropriate cutout 106 which cooperates as a closure for case 100. A clip 108 is provided on one sidewall of case 100. Clip 108 has oppositely extending clip members 110 and 112. With clip 112 engaged, as for example, on the shirt pocket of the user, the light as shown in FIG. 6 will not be illuminated. When the unit is reversed and clip 110 is engaged on the pocket of the user, mercury switch 82 will complete a circuit between conductors 78 and 80 causing the light to illuminate when the bulb is in the position shown in FIG. 6. This embodiment of the present invention is particularly useful for sportsmen, pilots and automobile drivers. The light can be used to illuminate maps for navigation, can easily be turned on and off by merely changing the position of the entire light. Further, the bulb can be pivoted to an out-of-the-way position to protect the bulb when not in use. The light is extremely useful in that the beam can be concentrated or directed to a particular location without causing distraction to the user.

From the foregoing, it will be seen that the present invention provides a unique, simple and novel flashlight especially adapted for use by sportsmen, pilots, automotive drivers and the like. The light of the present invention is simple and safe and is virtually nondestructible. The light of the present invention can be designed to accommodate any conventional size battery cell such as, size C or size D and can be adapted to use multiple batteries or multiple bulbs for a variety of uses. It will be obvious to those skilled in the art to make various changes, alterations and modifications to the invention described herein. To the extent that these changes, alterations and modifications do not depart from the spirit and scope of the appended claims, they are intended to be encompassed therein.

I claim:

1. A flashlight for use with at least two battery cells each having terminals at opposite first and second ends comprising:

(a) a frame for securing the said batteries in a generally side-by-side relationship defining a space therebetween, said frame including a first conductive element extending between a first set of battery terminals at the first end of said batteries, second conductor means extending from one of the battery terminals at said second end into said space and third conductor means extending from the other of said battery terminals at said second end into said space;

(b) switch means having an outer conductive body section, said conductive body section forming an electrical connection with said second conductor means;

(c) bulb holder means having an arm and a bulb receiving portion for receiving the terminal portion of a bulb, said bulb holder means being in electrical contact with said third conductor, said bulb receiving portion being adjacent said switch member and being rotatable about said third conductor whereby said bulb holder means is rotative from a second position placing said bulb terminal portion out of contact with said conductive body section and generally positioned in the space between said batteries to a first energized position placing said bulb terminal portion in electrical contact with the conductive body section thereby completing an electrical circuit.

2. The light of claim 1 wherein said batteries are angularly positioned in said frame with respect to one another.

3. The light of claim 1 further including a housing adapted to be removably secured over said batteries.

4. The light of claim 1 further including a housing adjusted to be secured over said batteries and clip means associated therewith for attaching the light to an article of apparel in either an "on" or "off" position.

5. The light of claim 1 further including a reflector detachably secured to said light.

6. The flashlight of claim 1 further including a motion responsive switch connected to one of said conductor elements, said motion responsive switch adapted to establish a circuit thereacross only when said flashlight is placed in a pre-determined position.

* * * * *